US005639051A

United States Patent [19]

Surbeck

[11] Patent Number: 5,639,051

[45] Date of Patent: Jun. 17, 1997

[54] TRASH BAG HOLDING DEVICE FOR PLASTIC GROCERY BAGS WITH LOOPED HANDLES

[76] Inventor: Donald Surbeck, 9008 Linn Station Rd., Louisville, Ky. 40222

[21] Appl. No.: 368,476

[22] Filed: Jan. 4, 1995

[51] Int. Cl.[6] ..... B65B 67/04

[52] U.S. Cl. ..... 248/100; 248/95; 248/99

[58] Field of Search ..... 248/95, 99, 100, 248/205.3

[56] References Cited

U.S. PATENT DOCUMENTS

| | | | |
|---|---|---|---|
| 3,188,031 | 6/1965 | Fournier | 248/95 |
| 4,669,689 | 6/1987 | Jones | 248/99 |
| 4,695,020 | 9/1987 | Collins | 248/95 X |
| 4,838,504 | 6/1989 | Bittenbinder | 248/100 |
| 4,881,706 | 11/1989 | Sedlik | 248/100 X |
| 4,884,603 | 12/1989 | Simpson | 248/99 X |
| 4,932,560 | 6/1990 | Roen | 248/95 X |
| 4,998,694 | 3/1991 | Barteaux | 248/100 |
| 5,160,103 | 11/1992 | Breitenstein | 248/100 |
| 5,222,702 | 6/1993 | Olmos | 248/95 |
| 5,246,190 | 9/1993 | Swirkal | 248/100 |
| 5,323,996 | 6/1994 | Rendall | 248/205.3 X |
| 5,433,413 | 7/1995 | Adams | 248/205.3 |

*Primary Examiner*—Alvin C. Chin-Shue
*Assistant Examiner*—Richard M. Smith
*Attorney, Agent, or Firm*—Wheat, Camoriano, Smith & Beres, PLC

[57] ABSTRACT

A plastic bag holding device which includes a pair of hooks and a base having a front surface and a rear surface adapted to abut against a flat surface of a cabinet door. The base is made with a top section thicker than a bottom section to provide a 5° cant from the plane of the cabinet door to the front surface of the device when it is in an abutting relationship with the cabinet door.

1 Claim, 2 Drawing Sheets

TRASH BAG HOLDING DEVICE FOR PLASTIC GROCERY BAGS WITH LOOPED HANDLES

BACKGROUND OF THE INVENTION

The present invention pertains to a trash bag holding device particularly suited for use with plastic grocery bags of the type having loop handles.

After purchasing groceries, people frequently save the grocery bags for later use for various purposes. For example, grocery bags have often been used as garbage bags and trash container liners. Until recent inroads made by plastic materials, grocery bags were largely made from stiff paper, ideally suited as trash bags or container liners because the bags kept their shape. Many grocery stores have either switched to or offer as a customer option light weight but durable plastic grocery bags as an economical or environmentally driven alternative. While the plastic bags are easily folded and stored due to the high flexibility thereof, convenient use as garbage bags is extremely limited. The bags are not sufficiently self-supporting enough to be substituted for the traditional at-home uses provided by the paper bag predecessors.

It is therefore one paramount object of the present invention to provide for a device permitting convenient use of plastic grocery bags as trash containers.

It is another object of the present invention to provide a device employed to use with plastic grocery bags that is easily accessible in the typical household.

Still another object of the present invention is to provide a device that can be used with plastic grocery bags of the looped handle type that can keep the bag open when hanging from the device to easily accept trash.

Other objects and advantages of the present invention will be evident following a reading of the detailed description and drawings as set forth below.

SUMMARY OF THE INVENTION

The present invention comprises a device for holding plastic bags having loop handles in a position to readily receive trash and includes a base having a front surface and a rear surface adapted to abut against a flat surface of a cabinet door, a pair of hooks positioned a distance apart about equal to the distance between loop handles of a plastic grocery bag so that the bag is tautly held across the top thereof. The base is made with its section toward the top part thereof when in place against a cabinet door thicker so as to provide about a 5° cant from the vertical to the front surface of the device when abutting the cabinet door. The taut condition in combination with the cant provides a slight opening to the mouth of the bag when the bag is in an "unfilled condition", nothing is in the bag. Securing elements are provided which serve to secure the rear surface of the base against the inside surface of a cabinet door thereby maintain the device in an abutting relationship with the door when the bag is in a trash filled condition.

DETAILED DESCRIPTION OF THE PREFERRED EMBODIMENT

Figure 1:
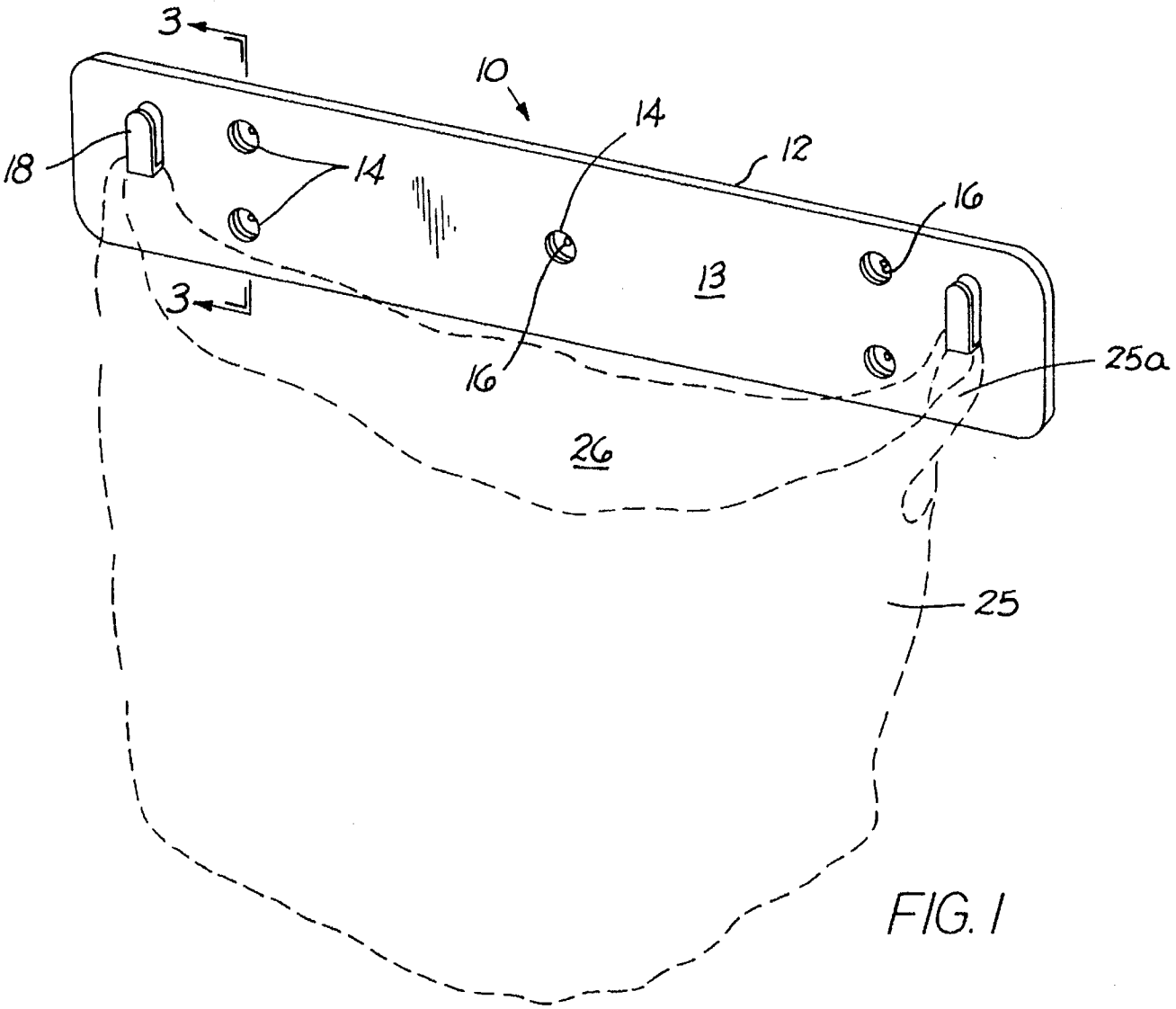
FIG. 1 is a perspective of trash bag holding device in accordance with the present invention in which the trash bag is shown in dashed lines.
Figure 3:
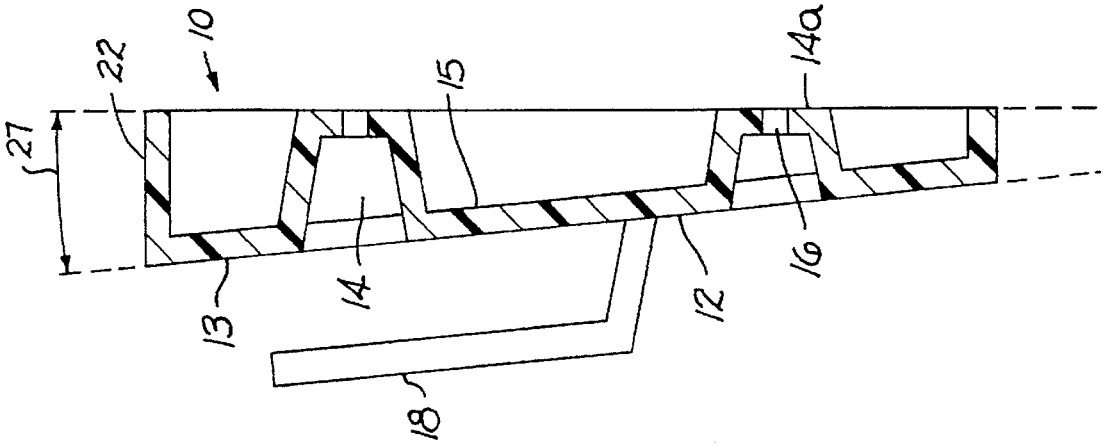
FIG. 3 is an enlarged side sectional view of the device taken along lines 3—3 of FIG. 1.

The perspective of FIG. 1 depicts bag holding device generally shown by character numeral 10 that is comprised of a base 12 with a front surface 13 and a rear surface 15 having counterbored bores 14 and bosses 14*a* (see FIGS. 2 and 3) with holes 16 for receiving fasteners and bag hooks 18 spaced approximately 11.5 inches apart (inner edge to inner edge). As illustrated, hooks 18 are preferably integral with base 12 and extend directly outwardly from the surface 13 of the base about 0.25 inches. It should be understood that the dimensions depend upon the "width" of the grocery bag between loop handles and will vary depending upon the size of the grocery bags.

Figure 2:
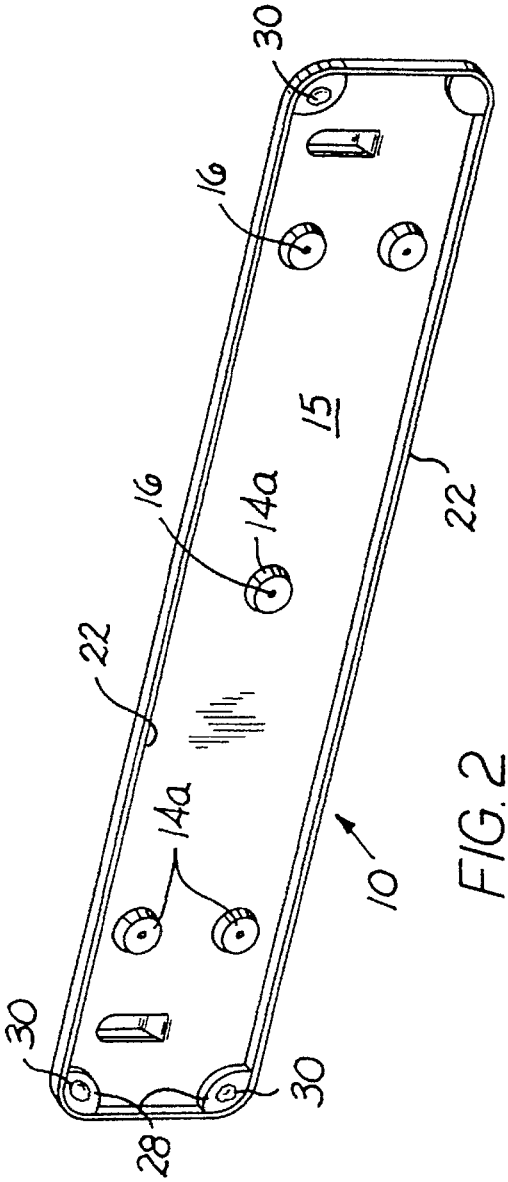
FIG. 2 is a rear view of the device shown in FIG. 1.

Alternatively, hooks 18 could be separately made and secured to base 12 with an adhesive or the like. The reverse side of device 10 shown in FIG. 2 provides a collectively planar surface for abutment against the flat inside surface of a substantially vertical supporting surface such as kitchen cabinet door, for example, so that the device and the accompanying bag are out of sight when not in use. When used on a wall anchors may be employed as required. Specifically, as shown in the rear perspective of FIG. 2, the collective planar surface comprises a flange 22 extending outwardly a predetermined distance from rear edge of base 12, the plurality of bosses 24 extending out the same predetermined distance, and a flat surface provided corners 28.

As shown, a bag 25 (in dashed lines) draped from hooks 10 by loop handles 25*a* is shown in an "unfilled state", i.e., no trash is contained by bag 25. To promote the opening of a plastic bag and easier access thereto in its original and unfilled condition, it is preferable that the bag hang at a slight angle. The base is cut so that the thickness at the top provides a cant angle 27 of about 5° to 10°, preferably about 5°, from the vertical. This can best be seen in the side section view of FIG. 3 where the actual angle 27 as drawn is exaggerated for clarity. More specifically, the flange 22 is canted so that, when the collective surface defined by the flange 22 and bosses 24, abuts a supporting wall, the front surface 13 is canted away from the vertical. The combination of this cant and the slight stretching of the loop handles 25*a* between hooks 10 causes the bag to have a slight opening of mouth 26 for the insertion of material initially. As gag 18 becomes more filled, the opening to mouth 26 naturally becomes larger.

Although bag holding device 10 is shown with counterbored bores 14 and holes 16 for receiving fasteners such as wood screws for securing the device to the cabinet door, the device could be supplied with self adhering adhesive covered by a paper backing until used since the total weight of the bag, even when in a "filled condition" i.e., filled with trash, will not be a significant factor. For example, corners 28 on the reverse side providing a flat surface for further abutment of the rear of device 10 against a cabinet door (not shown) would be ideally suited for an adhesive patch 30 such as shown in dashed lines.

The composition of the device is preferably of a light weight plastic material which lends itself to injection molding manufacturing techniques. Various types of stiff polypropylenes and polyvinyl chlorides are suitable, for example, as materials.

While the present invention has been described with the preferred embodiment as the focus, it should be understood that various changes and modifications can be made without departing from the intended scope and spirit of the claims.

I claim:

1. A device for holding plastic bags having loop handles in position to readily receive trash comprising:

(a) a substantially rectangular base having a front surface and a rear surface circumscribed at the edges thereof by a flange extending out from said rear surface;

(b) a pair of hooks integral with and extending directly out from said front surface of said base, said hooks positioned a distance apart about equal to the distance between loop handles of a plastic grocery bag so that the bag is tautly held across the top thereof; and (c) a plurality of spaced bosses defining openings adapted to receive securing elements for securing said device against he support surface and maintain said flange of said device in an abutting relationship with the support surface when said bag is in a trash filled condition, each of said bosses being integral with and extending out from said rear surface a distance sufficient to define together with said flange a collective planar surface adapted to abut against the support surface, said flange having an upward cant so that said front surface has between about a 5° to 10° upward cant with respect to a vertical plane when said collective planer surface abuts the support surface.

* * * * *